United States Patent [19]

Hanchar

[11] Patent Number: 4,667,277

[45] Date of Patent: May 19, 1987

[54] INDICATOR LAMP ASSEMBLY

[75] Inventor: Peter J. Hanchar, Chicago, Ill.

[73] Assignee: General Instrument Corporation, New York, N.Y.

[21] Appl. No.: 778,485

[22] Filed: Sep. 20, 1985

[51] Int. Cl.[4] ..... F21V 21/14

[52] U.S. Cl. ..... 362/250; 362/252; 362/800

[58] Field of Search ..... 362/249, 227, 234, 238, 362/236, 237, 368, 362, 800, 801, 250, 252

[56] References Cited

U.S. PATENT DOCUMENTS

| | | | |
|---|---|---|---|
| 3,082,397 | 3/1963 | Clarkson et al. | 339/157 |
| 4,302,800 | 11/1981 | Pelletier | 362/250 |
| 4,447,859 | 5/1984 | Raczynski | 362/236 |
| 4,471,415 | 9/1984 | Larson et al. | 362/249 |
| 4,555,749 | 11/1985 | Rifkin et al. | 362/249 |

FOREIGN PATENT DOCUMENTS

| | | | |
|---|---|---|---|
| 2117101 | 10/1978 | Fed. Rep. of Germany | 362/362 |

OTHER PUBLICATIONS

U.S. patent application Ser. No. 607,673 filed May 7, 1984 entitled "Led Circuit Board Indicator Housing and Tie Bar Assembly".

*Primary Examiner*—William A. Cuchlinski, Jr.
*Assistant Examiner*—D. M. Cox
*Attorney, Agent, or Firm*—Barry R. Lipsitz

[57] ABSTRACT

A base for an indicator lamp such as an LED includes a housing having a receptacle for the lamp. A male dovetail projects from a first side of the housing. A female dovetail channel is provided in a second side of the housing opposite the first side. The male and female dovetails have complementary dimensions. A plurality of the housings can be assembled into a lamp display by interlocking the male dovetail projection of one housing with the female dovetail channel of an adjacent housing. Additional male and female dovetail components can be provided on other sides of the housing to enable a plurality of housings to be assembled in various configurations. Channels provided in the rear wall of the housing accommodate wire leads from the indicator lamp mounted in the housing.

9 Claims, 7 Drawing Figures

INDICATOR LAMP ASSEMBLY

BACKGROUND OF THE INVENTION

The present invention relates to an indicator lamp assembly and more particularly to a mounting system for retaining a plurality of indicator lamps such as light emitting diodes (hereinafter LED) at predetermined spacings in a single unit for mounting on a printed circuit board.

In recent years, manufacturers of electronic equipment, including computers, electrical instruments, consumer products and the like have used groups of indicator lights to serve as function indicators and provide illuminated displays. The manufacturers of such electronic equipment have previously had to purchase individual indicator lights or light modules and then arrange the indicator lights or modules individually on a printed circuit board to achieve a desired configuration. This process requires special tooling and handling which increases the final cost of the electronic equipment.

It would be advantageous to provide a mounting system in which any number of indicator lamps can be provided in a variety of configurations using a standard lamp module. A plurality of such modules should be able to be interlocked to provide a single unit for use by the electronic equipment manufacturer. Such modules could be pre-assembled by the manufacturer thereof into indicator lamp display assemblies, or could be assembled by the electronic equipment manufacturer installing the lamps in a finished product. Applications of assembled display units include function mode and status mode indicators, bar graphs, light sources for back lighting legends, and through panel displays. The present invention relates to an indicator lamp base and indicator lamp assembly which provide such capabilities.

SUMMARY OF THE INVENTION

In accordance with the present invention, an indicator lamp base is provided that comprises a housing containing a receptacle for an indicator lamp. The indicator lamp can, for example, be an LED, an incandescent lamp, or other type of light source. A male dovetail projects from a first side of the housing. A female dovetail channel having complementary dimensions to the male dovetail is provided in a second side of the housing opposite the first side. Thus, a plurality of the housings can be assembled into a lamp display by interlocking the male dovetail projection of one housing with the female dovetail channel of an adjacent housing.

The indicator lamp base can further comprise a second male dovetail projecting from a third side of the housing and a second female dovetail channel in a fourth side of the housing opposite the third side. The second male and second female dovetails have complementary dimensions, whereby a plurality of said housings can be assembled together in various arrangements by interlocking mating dovetail projections and channels. In this manner, for example, assemblies of rectangular indicator lamps can be made from the same indicator lamp bases with the indicator lamps in either a horizontal or a vertical orientation.

A rear wall can be provided in the housing to close one end of the receptacle. The indicator lamp is then mounted to emit light from the other end of the receptacle. The rear wall contains first and second openings to accommodate leads from the indicator lamp passing therethrough. First and second perpendicular grooves are provided in the outer surface of the rear wall intersecting with and extending from the first opening. A third groove parallel to the first groove in the outer surface of the rear wall intersects with and extends from the second opening. The grooves are used to house and thereby orient the lead wires extending from the indicator lamp. The arrangement of grooves enables the indicator lamp leads to point in one direction for horizontal mounting of the indicator lamp assembly or in another direction perpendicular to the first direction for vertical mounting of the lamp assembly on a circuit board.

DETAILED DESCRIPTION OF THE INVENTION

Figure 1:
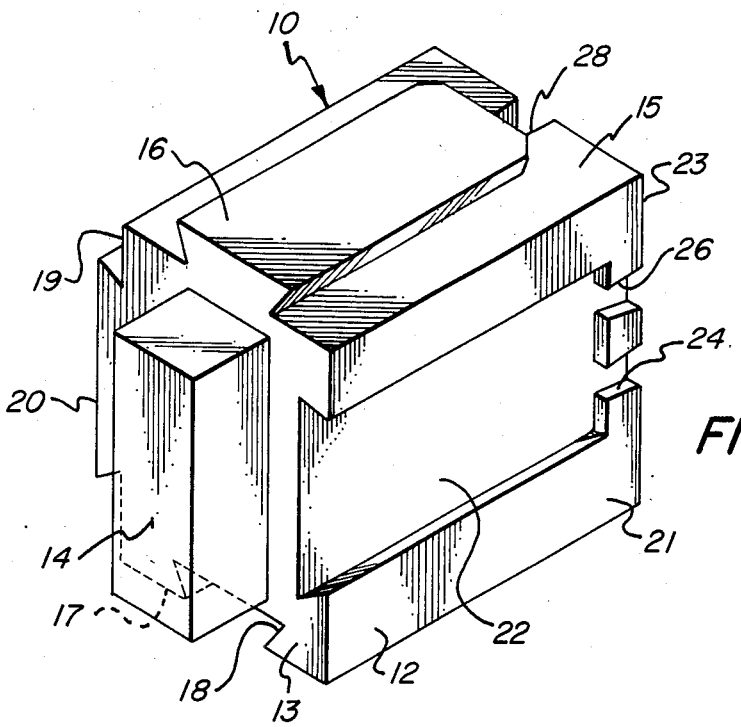
FIG. 1 is a front perspective view of an indicator lamp assembly in accordance with the present invention.
Figure 2:
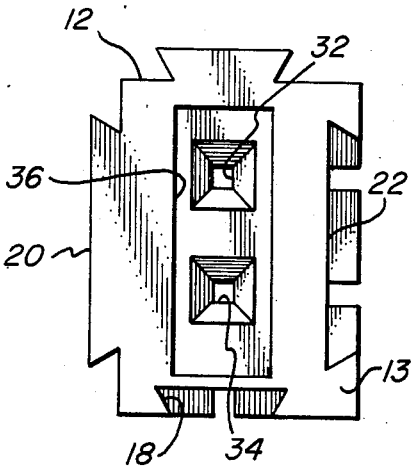
FIG. 2 is a front plan view of the indicator lamp base of FIG. 1 from which the indicator lamp has been removed.

Referring now to FIG. 1, an indicator lamp assembly generally designated 10 includes a housing or module 12 that contains an indicator lamp 14 projecting from a front wall 13 thereof. Housing 12 is preferably made from a plastic material such as nylon. Indicator lamp 14 is mounted in a receptacle 36 of housing 12 shown in FIG. 2. Chamfered holes 32, 34 are provided to accommodate leads from indicator lamps 14 passing therethrough.

Housing 12 includes a male dovetail 16 projecting from the top wall 15 thereof. A first female dovetail channel 18 is provided in the bottom wall 17 of housing 12. First male dovetail 16 and first female dovetail channel 18 have complementary dimensions so that a plurality of housings 12 can be assembled into a lamp display by interlocking mating dovetail projections 16 and channels 18.

Housing 12 also includes a second male dovetail 20 projecting from side wall 19. A second female dovetail channel is provided in side wall 21 which has dimensions that are complementary to those of second male dovetail 20. Thus, a plurality of housings 12 can be assembled together into a lamp display by interlocking mating dovetail projections 20 with channels 22.

Figure 6:
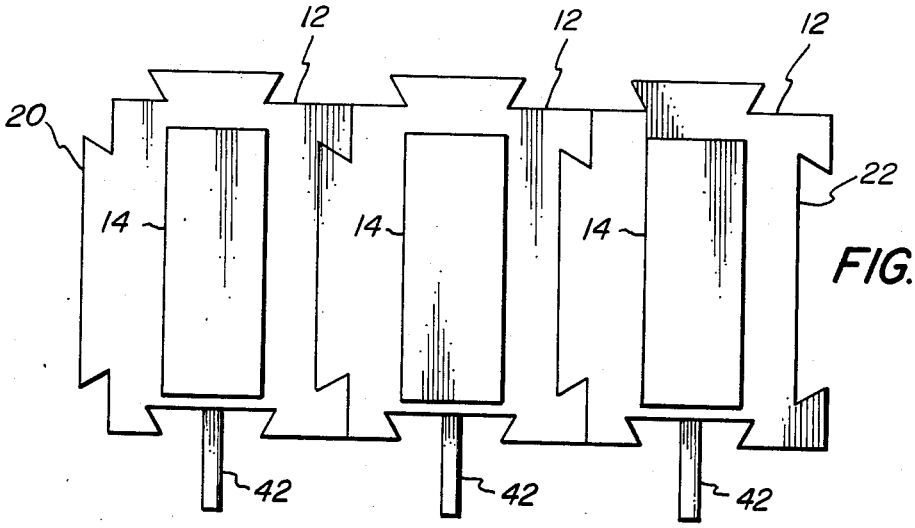
FIG. 6 is a front plan view of a plurality of indicator lamp assemblies interlocked together to form a vertical display.
Figure 7:
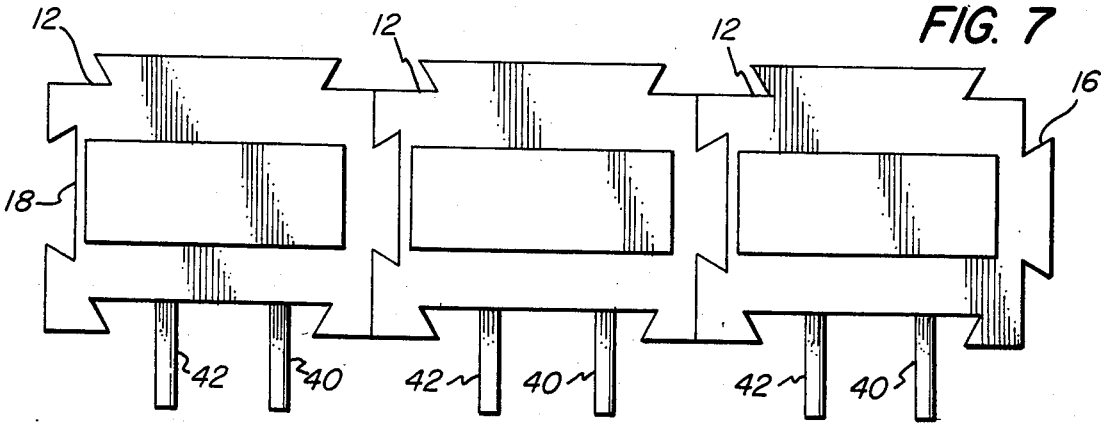
FIG. 7 is a front plan view of a plurality of indicator lamp assemblies interlocked together to form a horizontal display.

A plurality of indicator lamp assemblies 10 arranged into a display with vertically oriented indicator lamps is shown in FIG. 6. In this arrangement, dovetail projections 20 are interlocked with female dovetail channels 2 2 of adjacent housings. FIG. 7 illustrates a plurality of indicator lamp assemblies 10 arranged into a horizontal display by interlocking adjacent dovetail projections 16 with female dovetail channels 18. It will be appreciated that any number of indicator lamp assemblies can be arranged into a single unit by interlocking appropriate dovetail projections and channels. A user need only choose the number of desired indicator lamps for a display, their color sequence and position, and the complete display is then easily assembled from the individual indicator lamp assemblies.

Figure 3:
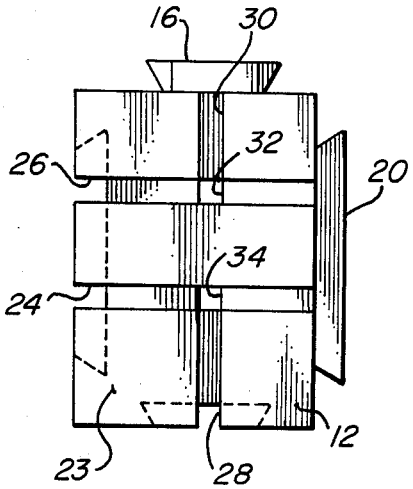
FIG. 3 is a rear view of the indicator lamp base.
Figure 4:
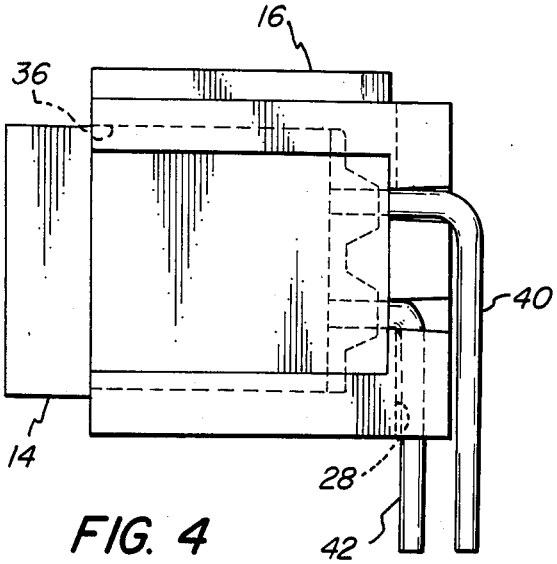
FIG. 4 is a side view of the indicator lamp assembly illustrating the orientation of the indicator lamp lead wires for vertical mounting thereof.
Figure 5:
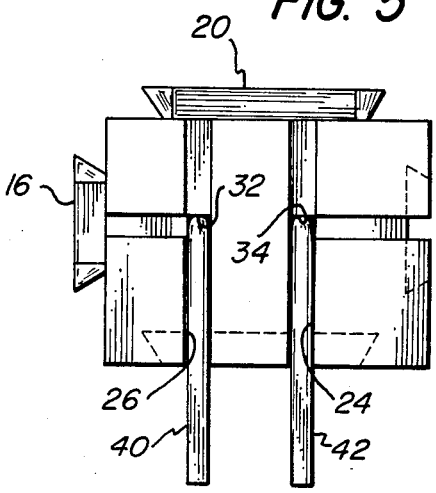
FIG. 5 is a rear view of the indicator lamp assembly illustrating the indicator lamp lead wires oriented for horizontal mounting thereof.

Turning to FIG. 3, a rear view of housing 12 is provided. Rear wall 23 of housing 12 includes first and second openings 34, 32 to accommodate the electrical leads of an indicator lamp 14. A first groove 24 and second groove 28 in the outer surface of rear wall 23 intersect with and extend from first opening 34. Grooves 24 and 28 are perpendicular to each other. A third groove 26 in the outer surface of rear wall 23 intersects with and extends from second opening 32. A fourth groove 30 in the outer surface of rear wall 23 intersects with second opening 32 and extends perpendicularly from third groove 26. Grooves 24 and 26 are parallel and accommodate leads 40, 42 which are bent to lie within the grooves when the indicator lamp assembly is used in its horizontal position. Groove 28 accommodates lead 42 in a similar manner when the indicator lamp assembly is used in its vertical position as shown in FIG. 4. In the vertical position, wire lead 40 is bent over wire lead 42 in parallel arrangement therewith, but wire lead 40 does not sit within a groove. Groove 30 is provided for use when a vertical mounting of the assembly is desired with male dovetail 16 at the bottom of the assembly instead of at the top thereof.

It will now be appreciated that the present invention provides an indicator lamp module which can be assembled together with other identical modules to form variously configured displays. The modules can be constructed in shapes different from the rectangular shape depicted in the drawings, and various shapes and types of light sources can be mounted in the modules. It should be understood that various changes, adaptations and modifications may be made without departing from the spirit and scope of the present invention as set forth in the appended claims.

What is claimed is:

1. An indicator lamp base comprising:

a housing having a pair of opposed top and bottom walls, said walls defining a receptacle for an indicator lamp;

a first male dovetail projecting from said top wall;

a first female dovetail channel in said bottom wall, said first male and first female dovetails having complementary dimensions;

a second male dovetail projecting from one of said side walls; and a second female dovetail channel in the other side wall, said second male and second female dovetails having complementary dimensions, whereby a plurality of said housings can be assembled into a lamp display by interlocking mating dovetail projections and channels;

a rear wall connecting said top, bottom, and side walls to close off said receptacle at the rear end thereof;

first and second openings in said rear wall;

first and second grooves in the outer surface of said rear wall intersecting with and extending from said first opening; and a third groove in the outer surface of said rear wall intersecting with and extending from said second opening.

2. The indicator lamp base of claim 1 wherein said first and third grooves are parallel.

3. The indicator lamp base of claim 2 wherein said first and second grooves are perpendicular.

4. The indicator lamp base of claim 3 wherein said first and third grooves extend across said rear wall from the top wall to the bottom wall.

5. The indicator lamp base of claim 4 further comprising:

a fourth groove in the outer surface of said rear wall intersecting with said second opening and extending perpendicularly from said third groove.

6. The indicator lamp base of claim 1 wherein said first and second openings are chamfered from the inside of said receptacle.

7. An indicator lamp assembly comprising:

a housing containing a receptacle for an indicator lamp;

an indicator lamp mounted in said receptacle;

a male dovetail projecting from a first side of said housing; and a female dovetail channel in a second side of said housing opposite said first side, the male and female dovetails having complementary dimensions;

whereby a plurality of said indicator lamp assemblies can be assembled into a lamp display by interlocking the male dovetail projection of one housing into the female dovetail channel of an adjacent housing;

a rear wall closing the other end of said receptacle, said rear wall containing first and second openings to accommodate leads from the indicator lamp passing therethrough;

first and second perpendicular grooves in the outer surface of said rear wall intersecting with and extending from said first opening; and a third groove parallel to said first groove in the outer surface of said rear wall intersecting with and extending from said second opening.

8. The indicator lamp assembly of claim 7 further comprising:

a fourth groove in the outer surface of said rear wall intersecting with said second opening and extending perpendicularly from said third groove.

9. The indicator lamp assembly of claim 7 further comprising:

a second male dovetail projecting from a third side of said housing; and a second female dovetail channel in a fourth side of said housing opposite said third side, said second male and second female dovetails having complementary dimensions;

whereby a plurality of said indicator lamp assemblies can be assembled together in various arrangements by interlocking mating dovetail projections and channels.

* * * * *